US008220888B2

(12) United States Patent
Tamayama et al.

(10) Patent No.: US 8,220,888 B2
(45) Date of Patent: Jul. 17, 2012

(54) STORAGE WITH A SYMMETRIC HINGE ASSEMBLY

(75) Inventors: Hiroshi Tamayama, Ashikaga (JP); Hideki Yamaguchi, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 570 days.

(21) Appl. No.: 12/178,080

(22) Filed: Jul. 23, 2008

(65) Prior Publication Data

US 2009/0025178 A1 Jan. 29, 2009

(30) Foreign Application Priority Data

Jul. 26, 2007 (JP) ..... 2007-194713

(51) Int. Cl.
*A47B 96/04* (2006.01)

(52) U.S. Cl. ..... 312/405; 16/230; 16/231; 16/387; 16/389; 16/DIG. 23

(58) Field of Classification Search ..... 312/405, 312/326–329, 138.1, 109, 116, 139; 49/381, 49/388, 397, 399; 16/352, 353, 344, 371, 16/374, 82, 83, 377, 238, 245, 246, 255, 16/288, 294, 302, 297, 382, 286, 281, 389, 16/230, 231, DIG. 23, 387, 72, 221; 248/220.1, 248/240

See application file for complete search history.

(56) References Cited

U.S. PATENT DOCUMENTS 1,158,341 A * 10/1915 Voelker ..... 49/388
2,392,689 A * 1/1946 Peglow ..... 16/294
2,579,785 A * 12/1951 Brownlie et al. ..... 16/389
2,777,722 A * 1/1957 Burke ..... 292/332
2,903,149 A * 9/1959 Turner ..... 217/60 E
3,112,514 A * 12/1963 Ostrom ..... 16/289
3,254,452 A * 6/1966 Costantini et al. ..... 49/386

(Continued)

FOREIGN PATENT DOCUMENTS

JP 51-48562 10/1974

(Continued)

OTHER PUBLICATIONS

Japanese Office Action mailed Sep. 20, 2011, in counterpart JP 2007-194713, with English Translation.

*Primary Examiner* — Darnell Jayne
*Assistant Examiner* — Hiwot Tefera
(74) *Attorney, Agent, or Firm* — Kratz, Quintos & Hanson, LLP

(57) ABSTRACT

An object is to provide a storage in which a door can be attached using a similar hinge without any trouble even at a time when the door is rotated in reverse and attached, the storage includes a main body; a pair of upper and lower hinges attached to the main body; and a door having one side rotatably supported by both the hinges to openably close an opening, at least one of the hinges has two attachment portions which cross each other at right angles in a corner and which are attached to the main body, and two pivot support portions raised from both the attachment portions and provided with a rotary shaft rotatably supporting the door, and both the attachment portions and both the pivot support portions have a shape which is symmetric with respect to a line passing through the corner and forming an angle of 45° with respect to both the attachment portions.

2 Claims, 5 Drawing Sheets

U.S. PATENT DOCUMENTS

| | | | | | |
|---|---|---|---|---|---|
| 3,353,854 | A * | 11/1967 | Hansen | 403/171 |
| 3,506,292 | A * | 4/1970 | Hagendoorn et al. | 292/78 |
| 3,511,106 | A * | 5/1970 | Deeby | 74/501.6 |
| 3,523,323 | A * | 8/1970 | Jorgensen | 16/302 |
| 3,549,246 | A * | 12/1970 | Ruesch | 351/113 |
| 3,608,129 | A * | 9/1971 | Heyer | 16/291 |
| 3,966,056 | A * | 6/1976 | Larson | 211/134 |
| 4,310,948 | A * | 1/1982 | Rock et al. | 16/335 |
| 4,690,468 | A * | 9/1987 | Lau | 312/291 |
| 4,760,623 | A * | 8/1988 | Toyama | 16/238 |
| 4,774,740 | A * | 10/1988 | Gidseg et al. | 16/344 |
| 4,864,691 | A * | 9/1989 | Gidseg et al. | 16/312 |
| 4,875,252 | A * | 10/1989 | Falconer et al. | 16/288 |
| 5,027,473 | A * | 7/1991 | Hottmann | 16/286 |
| 5,158,503 | A * | 10/1992 | Mitchell | 16/278 |
| 5,220,747 | A * | 6/1993 | Cherry et al. | 49/386 |
| 5,272,789 | A * | 12/1993 | Mitchell et al. | 16/291 |
| 5,312,078 | A * | 5/1994 | Marsh | 248/220.1 |
| 5,497,534 | A * | 3/1996 | Caruso | 16/288 |
| 5,522,656 | A * | 6/1996 | Jenkins | 292/79 |
| 5,579,606 | A * | 12/1996 | Kim | 49/386 |
| 6,375,291 | B1 * | 4/2002 | Nam et al. | 312/405 |
| 6,418,590 | B1 * | 7/2002 | Nipper et al. | 16/382 |
| 6,434,792 | B1 * | 8/2002 | Williamson | 16/389 |
| 6,453,804 | B1 * | 9/2002 | Lee | 99/470 |
| 6,457,278 | B1 * | 10/2002 | Fleming | 52/37 |
| 6,658,694 | B2 * | 12/2003 | Wang | 16/50 |
| 6,766,561 | B1 * | 7/2004 | Cheng | 16/235 |
| 6,845,545 | B2 * | 1/2005 | Han et al. | 16/277 |
| 7,096,535 | B2 * | 8/2006 | Lin | 16/287 |
| 7,192,105 | B2 * | 3/2007 | Jung | 312/405 |
| 7,240,397 | B2 * | 7/2007 | Han | 16/50 |
| 7,337,499 | B2 * | 3/2008 | Zhang et al. | 16/357 |
| 7,344,211 | B2 * | 3/2008 | Gomoll | 312/405 |
| 7,350,664 | B2 * | 4/2008 | Nam et al. | 220/264 |
| 7,526,894 | B2 * | 5/2009 | Falato et al. | 49/236 |
| 7,543,356 | B2 * | 6/2009 | Zetti | 16/288 |
| 7,721,388 | B2 * | 5/2010 | Lee | 16/286 |
| 2004/0040118 | A1 * | 3/2004 | Han et al. | 16/277 |
| 2004/0068841 | A1 * | 4/2004 | Koshikawa et al. | 16/277 |
| 2004/0172787 | A1 * | 9/2004 | Collene et al. | 16/289 |
| 2005/0194875 | A1 * | 9/2005 | Reed et al. | 312/405.1 |
| 2005/0258724 | A1 * | 11/2005 | Hwa Kim | 312/405 |
| 2007/0101542 | A1 * | 5/2007 | Lee | 16/286 |
| 2007/0169416 | A1 * | 7/2007 | Falato et al. | 49/397 |

FOREIGN PATENT DOCUMENTS

| | | |
|---|---|---|
| JP | 59-80683 | 5/1984 |
| JP | 1-63988 | 4/1989 |
| JP | 3-228712 | 10/1991 |
| JP | 7-305946 | 11/1995 |
| JP | 8-312236 | 11/1996 |
| JP | 2007-85639 | 4/2007 |

* cited by examiner

STORAGE WITH A SYMMETRIC HINGE ASSEMBLY

BACKGROUND OF THE INVENTION

The present invention relates to a storage provided with a pair of upper and lower hinges attached to a main body and a door having one side rotatably attached to both the hinges to openably close an opening. More particularly, it relates to a hinge structure.

Heretofore, in a storage or the like in which a storage chamber is constituted and which is provided with a door for openably closing an opening in this storage chamber, a constitution has been employed in which from a viewpoint of convenience in an opening/closing operation, a pair of hinges are attached to the upper and lower portions of the main body provided with the opening, and one side of the door is rotatably supported by both the hinges to openably close the opening.

For example, as disclosed in Japanese Patent Application Laid-Open No. 8-312236, a bracket constituting a lower hinge device is constituted of an attachment portion to be attached to the main body via screws, and a substantially horizontal support portion, and a lower member provided with a hollow shaft is attached to the support portion via screws. On the other hand, an attachment portion stopper provided with a hole to be superimposed on a hole formed in a door lower surface is attached to the lower surface of the door via screws, and an upper member provided with an upwardly projecting collar is fixed to the lower portion of this stopper via screws in a state in which the collar is screwed into the hole.

Moreover, the shaft of the lower member is inserted into the downwardly opening inner space of the upper member, whereby the lower part of the door is rotatably attached to the main body. Similarly, the upper part of the door is rotatably attached to the main body via an upper hinge device. In consequence, the door is rotated around one side of the front surface opening to openably close the opening.

In the conventional hinge device constitution, in a case where the door is constituted so as to be rotatable around a predetermined position, for example, the left side portion of the opening as one faces the door, the bracket attached to the lower member provided with the shaft is formed into a shape only to be attached to the left lower portion of the opening. Therefore, to change the rotating direction of the door in the installation place of the storage, there has been a problem that the door has to be attached using a separately manufactured bracket.

Therefore, the components of the hinge device have low versatility, so that the components corresponding to the respective rotating directions need to be produced. This raises production cost, and it is difficult to change the door rotating direction. This raises a problem that use configuration is limited.

SUMMARY OF THE INVENTION

The present invention has been developed in order to solve a conventional technical problem, and an object thereof is to provide a storage in which a door can easily be attached using a similar hinge even at a time when the door is rotated in reverse and attached.

A storage according to a first aspect of the invention is characterized by comprising: a main body; a pair of upper and lower hinges attached to the main body; and a door having one side rotatably supported by both the hinges to openably close an opening, wherein at least one of the hinges has two attachment portions which cross each other at right angles in a corner and which are attached to the main body, and two pivot support portions raised from both the attachment portions and provided with a rotary shaft rotatably supporting the door, and both the attachment portions and both the pivot support portions have a shape which is symmetric with respect to a line passing through the corner and forming an angle of 45° with respect to both the attachment portions.

The storage according to a second aspect of the invention is characterized in that in the above invention, the rotary shaft is detachably attached to both the pivot support portions.

The storage according to a third aspect of the invention is characterized in that the above invention further comprises: an automatic closing mechanism which urges the door in a closing direction, the automatic closing mechanism including a compression spring; a first pin provided in a position different from that of the rotary shaft on one of the pivot support portions raised from one of the attachment portions attached to the main body; a second pin provided on the door; a first hook which connects one end of the compression spring to the first pin; and a second hook which connects the other end of the compression spring to the second pin.

The storage according to a fourth aspect of the invention is characterized in that in the above invention, one end of the compression spring is attached to the distal end of the first hook, the proximal end of the first hook is rotatably connected to the first pin, and the distal end of the first hook has such a shape that the distal end passes by a front part from the distal end of the other pivot support portion raised from the other attachment portion in a case where the door is opened.

The storage according to a fifth aspect of the invention is characterized in that in the above second to fourth aspects of the invention, the first pin is attached to the pivot support portion via the spacer.

According to the first aspect of the invention, in the storage comprising: the main body; the pair of upper and lower hinges attached to the main body; and the door having one side rotatably supported by both the hinges to openably close the opening, at least one of the hinges has two attachment portions which cross each other at right angles in the corner and which are attached to the main body, and two pivot support portions raised from both the attachment portions and provided with the rotary shaft rotatably supporting the door, and both the attachment portions and both the pivot support portions have the shape which is symmetric with respect to the line passing through the corner and forming an angle of 45° with respect to both the attachment portions. In consequence, when the door is rotated in reverse and attached, the hinge having the same shape is rotated as much as 90° around the corner, and can thus be used in common.

Therefore, even in a case where the pivot support side of the door with respect to the main body, that is, the attachment side with the hinge is arbitrarily changed in an installation place, the common hinge can be used, and the decrease of the number of the components and the improvement of convenience can be achieved.

According to the second aspect of the invention, in the above invention, the rotary shaft is detachably attached to both the pivot support portions. Therefore, the door can be used in a state in which the rotary shaft is attached only to the pivot support portion on a door pivot support side, and the rotary shaft is not attached to the pivot support portion on a side where the door is not rotatably supported. It is possible to avoid a disadvantage that the rotary shaft projects externally from the pivot support portion on the side where the door is not rotatably supported.

In consequence, even in a case where the common hinge is used, a disadvantage that the component projects externally can be avoided, and a preferable use configuration can be realized.

According to the third aspect of the invention, the above invention further comprises the automatic closing mechanism which urges the door in the closing direction, and the automatic closing mechanism includes the compression spring; the first pin provided in the position different from that of the rotary shaft on one of the pivot support portions raised from one of the attachment portions attached to the main body; the second pin provided on the door; the first hook which connects one end of the compression spring to the first pin; and the second hook which connects the other end of the compression spring to the second pin. Therefore, the door is automatically closed owing to the function of the elastic force of the compression spring, whereby the end of the compression spring to which the force is easily applied is not easily broken. Therefore, the durability of the compression spring can be improved.

According to the fourth aspect of the invention, in the above invention, one end of the compression spring is attached to the distal end of the first hook, the proximal end of the first hook is rotatably connected to the first pin, and the distal end of the first hook has such a shape that the distal end passes by the front part from the distal end of the other pivot support portion raised from the other attachment portion in a case where the door is opened. Therefore, even in a case where a line connecting the first pin to the second pin is opened externally from the distal end of the other pivot support portion that is not used, the compression spring can be constituted so that the spring does not abut on the pivot support portion.

In consequence, it is possible to prevent a disadvantage that the compression spring abuts on the pivot support portion which is not used and is broken.

According to the fifth aspect of the invention, in the above second to fourth aspects of the invention, the first pin is attached to the pivot support portion via the spacer. Therefore, the thickness of the pivot support portion can substantially be increased owing to the spacer, and the attachment strength of the first pin can be increased.

At this time, it is not constituted that the thickness of the pivot support portion itself is increased, and the substantial increase of the thickness can be achieved by the separately formed spacer, whereby productivity can be increased.

DETAILED DESCRIPTION OF THE PREFERRED EMBODIMENT

Figure 1:
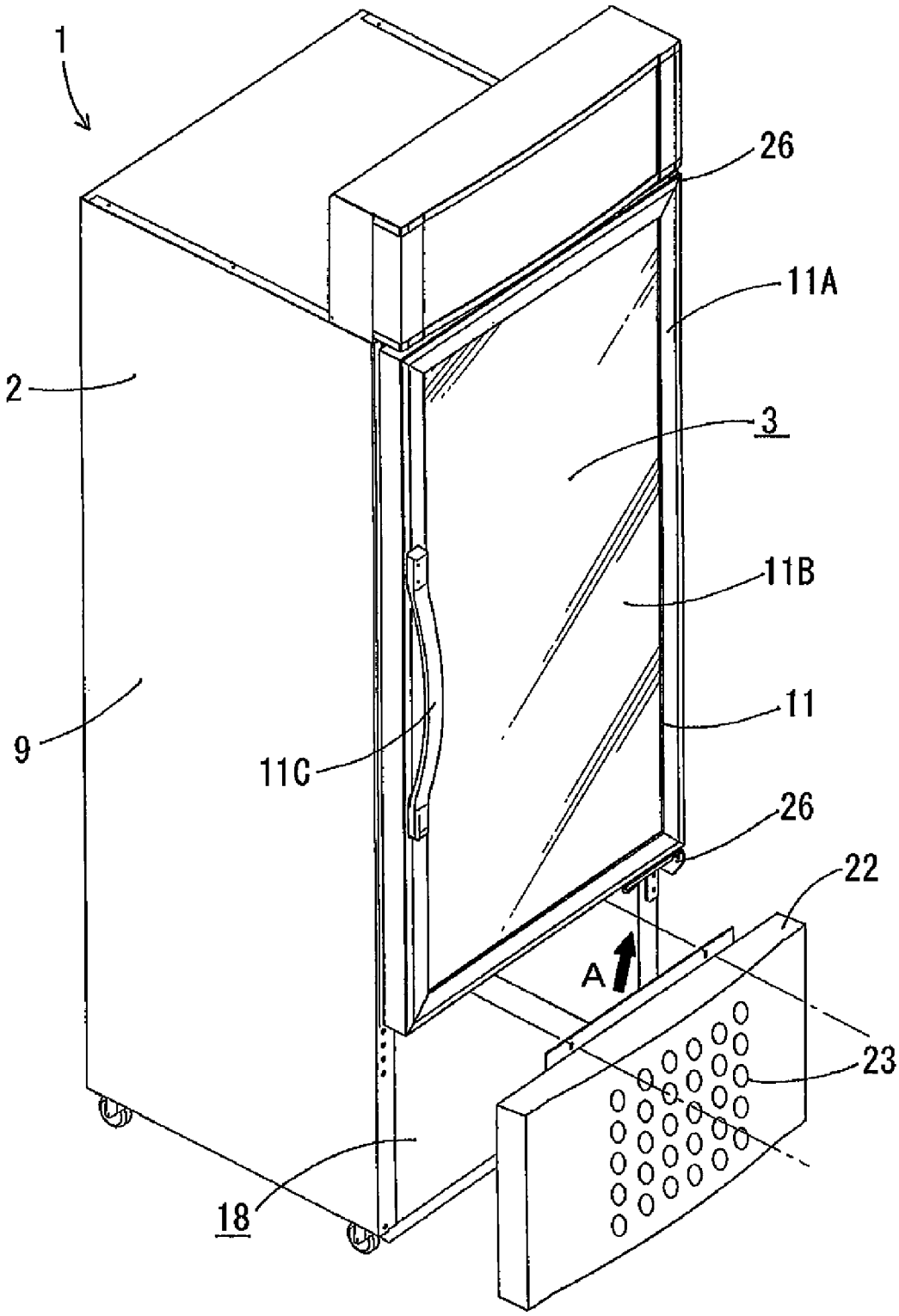
FIG. 1 is a perspective view showing a storage according to the present invention.
Figure 2:
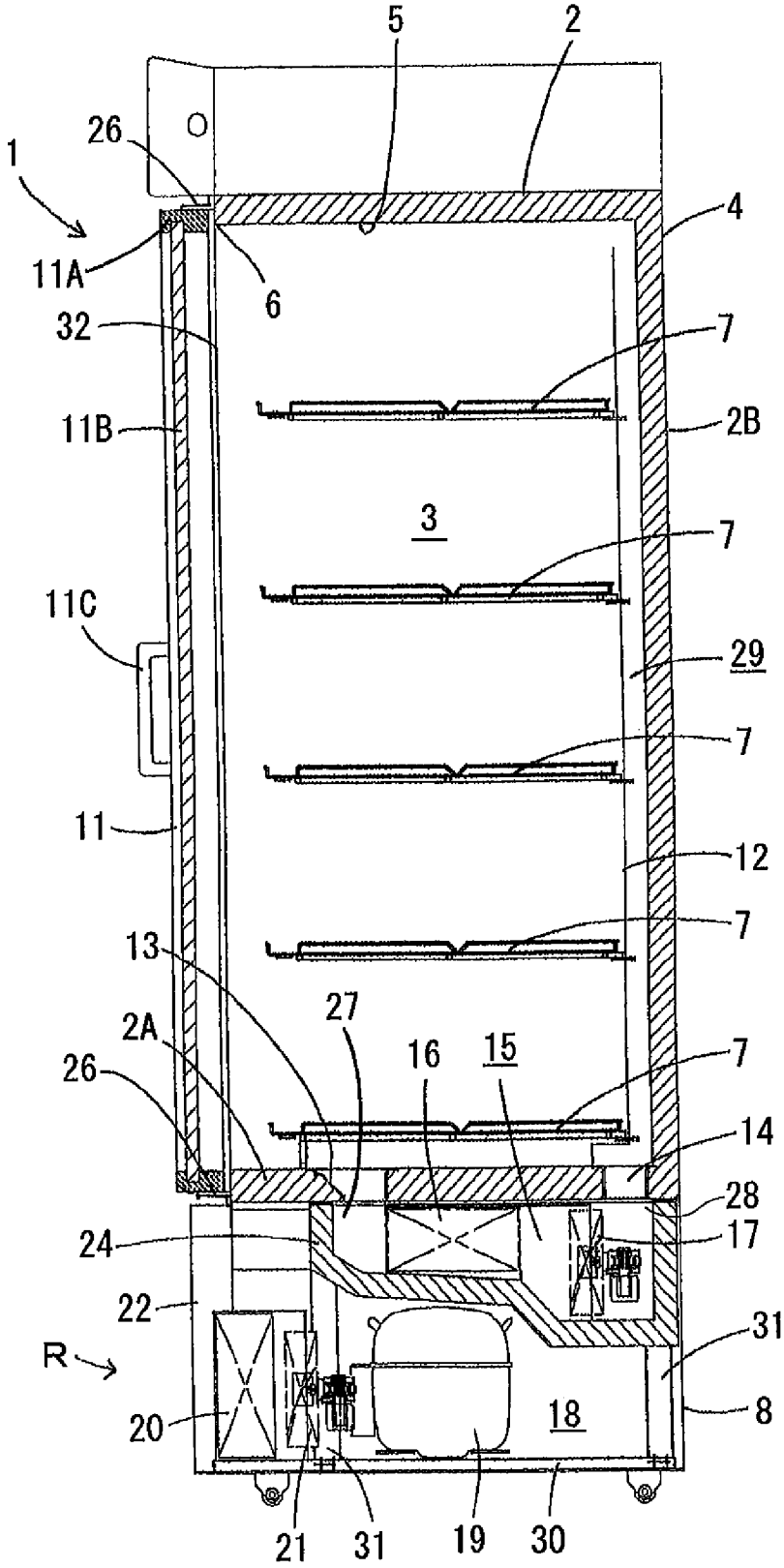
FIG. 2 is a vertical side view of FIG. 1.

Next, one embodiment of a storage in which the present invention is employed will be described with reference to FIGS. 1 and 2. FIG. 1 is a perspective view showing a storage 1 according to the present invention, and FIG. 2 is a vertical side view of FIG. 1. The storage 1 according to the present embodiment is a cooling showcase installed in a convenience store, a supermarket or the like, and is constituted of a main body 2 including an insulating box body having an opening 6 in a front surface.

This main body 2 is constituted of an outer box 4 made of a steel plate and having an opened front surface, an inner box 5 made of a steel plate or a hard synthetic resin, incorporated in this outer box 4 with a space disposed internally from the outer box and having an opened front surface, and an insulating material made of foam polyurethane foamed and inserted between the outer box 4 and the inner box 5. Further in the main body 2, a storage chamber 3 having an opened front surface is formed, and the front surface opening 6 of the storage chamber 3 is openably closed with a door 11 described later in detail. Moreover, the storage chamber 3 is provided with a plurality of stages of shelves 7 . . . on which food and the like are to be disposed.

A base leg angle 8 having a predetermined height is attached to the bottom surface of the main body 2, and both side surfaces of the base leg angle 8 together with both side surfaces of the main body 2 are covered with face panels 9. In consequence, a mechanical chamber 18 is formed in the lower part of the main body 2. Moreover, a cold air suction port 13 and a cold air discharge port 14 are formed in the front and rear parts of a bottom wall 2A of the main body 2 so that the ports extend through the insulating material.

A cooling box 24 having an opening in the upper surface thereof is disposed so as to abut on the lower surface of the bottom wall 2A of the main body 2 which constitutes the ceiling of the mechanical chamber 18. In this cooling box 24, a cooling chamber 15 is formed, and a cooler 16 constituting a cooling device R is arranged. A blower 17 for the cooler is arranged before the cooler 16. It is to be noted that the upper surface opening of the cooling box 24 is provided with a cold air suction port 27 and a cold air discharge port 28 formed by a partition plate in the cooling box 24. The cold air suction port 27 and the cold air discharge port 28 correspond to the cold air suction port 13 and the cold air discharge port 14 formed in the bottom wall 2A of the main body 2, respectively.

On the other hand, a partition plate 12 constituting a duct 29 which connects the cold air discharge port 14 formed in the bottom wall 2A to the upper part of the storage chamber 3 is attached on the inner side of a back wall 2B of the main body 2. This partition plate 12 is provided with a plurality of openings (not shown) for supplying cold air discharged from the blower 17 for the cooler. In consequence, the cold air is effectively supplied into the storage chamber 3.

On the other hand, in the mechanical chamber 18, an attachment base 30 constituting the bottom part of a cooling unit is received, and this attachment base 30 is provided with a compressor 19, a condenser 20, a blower 21 for the condenser and the like constituting the cooling device R together with the cooler 16. Moreover, an openable/closable front surface panel 22 and the like are attached to the front surface of the mechanical chamber 18 to shield the mechanical chamber 18. It is to be noted that this front surface panel 22 is provided with a plurality of ventilation holes 23 corresponding to front part of the condenser 20.

Here, the cooler 16 in the cooling box 24 is connected to the compressor 19 and the condenser 20 on the attachment base 30 via a refrigerant pipe to constitute a well known refrigerant circuit. Moreover, the cooling box 24 is detachably held by cooling box support jigs 31 . . . .

According to the above constitution, the compressor 19 of the cooling device R and the like are operated in a state in which the upper surface opening edge of the cooling box 24 abuts on the lower surface of the bottom wall 2A of the main body 2, whereby the cooler 16 exerts a cooling function and the inside of the storage chamber 3 is maintained at, for example, a predetermined refrigeration temperature.

Figure 3:
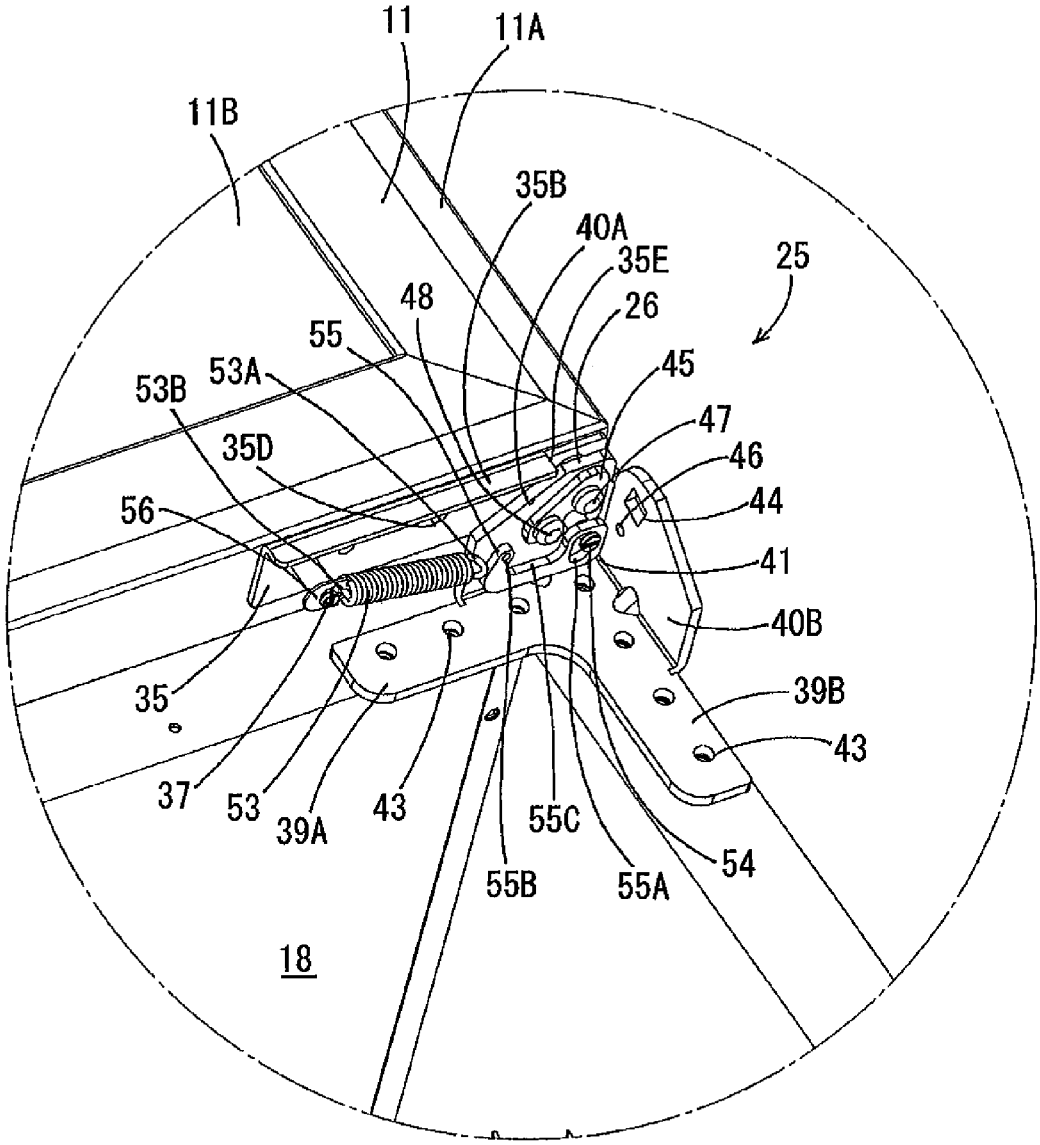
FIG. 3 is a partially enlarged perspective view showing FIG. 1 viewed from an arrow direction.
Figure 4:
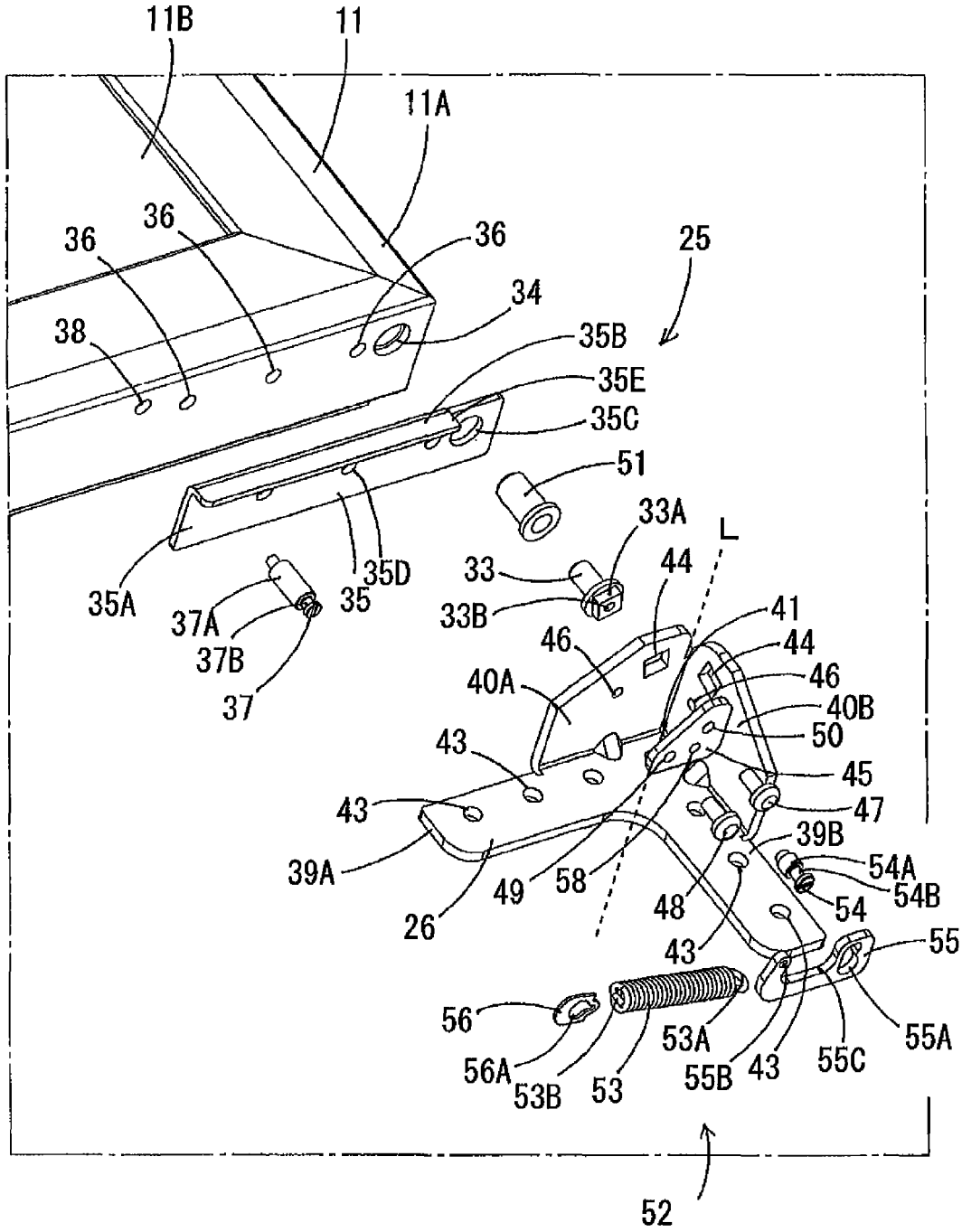
FIG. 4 is an exploded perspective view showing an opening/closing mechanism.
Figure 5:
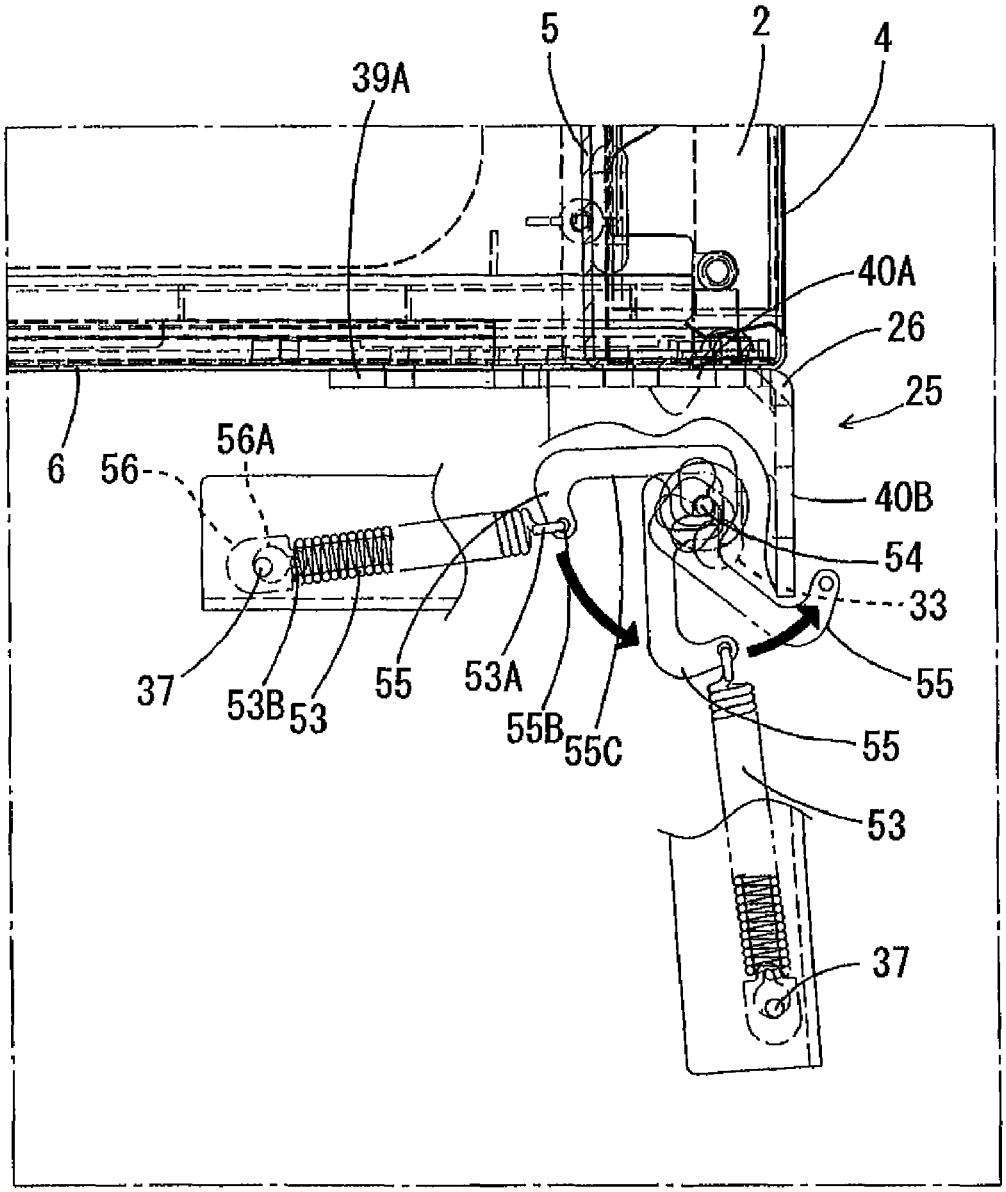
FIG. 5 is a flat sectional view showing the operation of the opening/closing mechanism.

Next, the door 11 and an opening/closing mechanism 25 of the door 11 will be described with reference to FIGS. 3 to 5. FIG. 3 is a partially enlarged perspective view of FIG. 1 viewed from a bold-line arrow A direction, FIG. 4 is an exploded perspective view showing the opening/closing mechanism 25, and FIG. 5 is a flat sectional view showing the operation of the opening/closing mechanism 25. It is to be noted that in FIG. 5, the door 11 is omitted in order to facilitate the understanding.

In the embodiment in which the door 11 described above is provided in the front surface opening 6, the door 11 is constituted of a frame body 11A rotatably supported by a pair of upper and lower hinges 26 in upper and lower edges (in the present embodiment, upper and lower right edges as one faces from the front surface) on one side, and a transparent plate 11B held by the frame body and constituted of a material through which the inside of the door can be seen. Shaft holes 34 for inserting shaft sleeves 51 described later are formed in the upper and lower edges of the frame body 11A to be attached to the hinges 26 on one side. Moreover, each of the upper and lower surfaces of the frame body 11A is provided with a plurality of screw holes 36 for fixing a door stopper 35 via screws, and a spring hole 38 for fixing a spring fixing pin (a second pin) 37 described later.

Moreover, on the front surface of this frame body 11A, a grasp member 11C for rotating the frame body 11A forwards is provided on a side opposite to a pivot support side, that is, on the left side as one faces from the front surface in the present embodiment. It is to be noted that a door packing 32 for improving a close contact property with respect to the edge of the opening 6 of the main body 2 is attached to the whole periphery of the rear surface of the frame member 11A.

As shown in FIG. 3, the lower opening/closing mechanism 25 is constituted of the hinge 26, the door stopper 35, a rotary shaft 33 and an automatic closing mechanism 52. The hinge 26 has an attachment portion 39A positioned on the downside of the door 11 of the main body 2 and fixed to the front surface of the edge of the opening 6 via screws, a pivot support portion 40A substantially vertically bent from the upper edge of the attachment portion 39A and fixed to the lower surface of the door 11 (the lower surface of the frame body 11A) via screws, and an attachment portion 39B and a pivot support portion 40B constitute substantially integrally with these attachment portion 39A and the pivot support portion 40A. These attachment portion 39B and the pivot support portion 40B are formed so as to cross the attachment portion 39A and the pivot support portion 40A at right angles in a corner 41, respectively, and formed into a shape which is symmetric with respect to a line (a dotted line L of FIG. 4) which passes through the corner 41 to form an angle of 45° with respect to both the attachment portions 39A, 39B. Moreover, the pivot support portions 40A and 40B preferably have a large plate thickness dimension from a viewpoint of strength, but the portions are formed so as to have a dimension of about 3 mm from a viewpoint of production cost in the present embodiment.

The respective attachment portions 39A, 39B are provided with a plurality of screw holes 43 . . . so that the portions abut on the front surface of the edge of the opening 6 and are fixed to the front surface via screws. The pivot support portions 40A, 40B are provided with shaft holes 44 for attaching the rotary shaft 33, and screw holes 46 for fixing a plate-like spacer 45 via a fixing screw 48. It is to be noted that the spacer 45 is also provided with a screw hole 49 which is to be superimposed on the screw hole 46 to fasten the screw and fix the spacer.

Here, each shaft hole 44 is formed into substantially the same shape (a square shape in the present embodiment) as that of a head portion 33A of the rotary shaft 33, and the hole has such a shape that the head portion 33A of the rotary shaft 33 can substantially exactly be inserted into the shaft hole 44. It is to be noted that the head portion 33A of the rotary shaft 33 is formed so as to have a thickness substantially equal to that of the pivot support portion 40A, 40B or the like. The lower surface of the head portion 33A is provided with a flange having a shape larger than the outer shape of the head portion 33A. Furthermore, the head portion 33A of the rotary shaft 33 is provided with a screw hole 33B for fixing the head portion with a shaft fixing screw 47 via the spacer 45. It is to be noted that the spacer 45 is also provided with a screw hole 50 which is to be superimposed on the screw hole 33B to fasten the screw and fix the rotary shaft.

On the other hand, the door stopper 35 is attached to the lower surface of the door 11 via screws. This door stopper 35 is constituted of a substantially horizontal attachment portion 35A attached to the lower surface of the door 11, and a stopper portion 35B formed by the substantially vertically bent front end of the attachment portion 35A. An end 35E of the stopper portion 35B on the side of the rotary shaft 33 abuts on the pivot support portion 40B which is not used in attaching the hinge 26 at a time when the door 11 is in a fully opened position, that is, a position rotated as much as approximately 120° from a closed position. Moreover, the attachment portion 35A is provided with an insertion hole 35C for inserting the shaft sleeve 51, a screw hole 35D for fixing the stopper to the lower surface of the door 11, and further a screw hole which is to be superimposed on the spring hole 38 formed in the lower surface of the door 11 to fasten the screw with the spring fixing pin 37 of the automatic closing mechanism 52. It is to be noted that the insertion hole 35C for inserting the shaft sleeve 51 can be superimposed on the shaft hole 34 formed in the lower surface of the door 11.

The inside of the shaft sleeve 51 is hollow, and opens downwards. Such an opening of the sleeve has such a dimension that the rotary shaft 33 is rotatably inserted into the opening.

Next, the automatic closing mechanism 52 which urges the opened door 11 in a closing direction will be described. The automatic closing mechanism 52 is constituted of a compression spring 53, a spring fixing pin (a first pin) 54, the spring fixing pin (the second pin) 37, a spring hook 55 (a first hook) and a spring hook 56 (a second hook).

The spring fixing pin 54 is engaged with and fixed to a screw hole 58 formed in the spacer 45, whereby the pin is fixed to the pivot support portion 40A raised from the attachment portion 39A for use in attaching the mechanism to the main body 2 as described above via the spacer 45. This spring fixing pin 54 has a shaft portion provided with a collar 54A, and a holding portion 54B which rotatably holds the spring hook 55 is formed between the shaft portion and a head portion. In this case, the screw hole 58 formed in the spacer 45 to which the spring fixing pin 54 is fixed is provided in a position different from that of the rotary shaft 33. It is to be noted that in the present embodiment, the spring fixing pin 54 is fixed only to the spacer 45 by the engagement, but this is not restrictive, and a screw hole may be provided in the pivot support portion 40A in a superimposed position to fasten the screw and fix the pin. In consequence, it is possible to further increase the strength of the spring fixing pin 54 to which a force is easily applied owing to the operation of the automatic closing mechanism 52 in the pin attachment position.

On the other hand, the spring fixing pin 37 is fastened together with the door stopper 35, and is thus fixed to the lower surface of the door 11. The pin has a shaft portion provided with a collar 37A, and a holding portion 37B which rotatably holds the spring hook 56 is formed between the shaft portion and a head portion.

The spring hook 55 has a proximal end provided with an attachment hole 55A into which the head portion of the spring fixing pin 54 is inserted, whereby the pin is rotatably held by the holding portion 54B. The spring hook has the other end provided with an attachment hole 55B for attaching one end 53A of a compression spring 53. It is to be noted that in order to facilitate the insertion of the spring fixing pin 54, the attachment hole 55A is formed in a state in which the rotating position of the spring fixing pin 54 rotated owing to the rotation of the door 11 is connected to an inserting position formed as a position eccentric from the rotation center and slightly larger than the rotating position. In consequence, the one end 53A of the compression spring 53 is connected to the spring hook 55 so as to be rotatable around the spring fixing pin 54. This spring hook 55 is also provided with an escape portion 55C cut and positioned between the attachment holes 55A and 55B.

The other spring hook 56 is provided with an attachment hole 56A into which another end 53B of the compression spring 53 and the head portion of the spring fixing pin 37 are inserted to rotatably hold the holding portion 37B. In consequence, the other end 53B of the compression spring 53 is connected to the spring hook 56 so as to be rotatable around the spring fixing pin 37 fixed to the door 11 side.

According to such a constitution, when the door 11 is attached to the main body 2, the attachment portion 39A of the hinge 26 is fixed to the front surface opening edge of the main body 2, and the head portion 33A of the rotary shaft 33 is then fitted into the shaft hole 44 formed in the pivot support portion 40A raised from the attachment portion 39A for use in the attachment. In this case, the shaft portion of the rotary shaft 33 extends toward the attachment side of the door 11, that is, upwards in the present embodiment. In this state, the spacer 45 is allowed to abut on the side on which the rotary shaft 33 does not extend, that is, the lower surface of the pivot support portion 40A, whereby the spacer 45 and the head portion 33A of the rotary shaft 33 projecting from the pivot support portion 40A are fastened together via the shaft fixing screw 47. Furthermore, the spacer 45 is fastened together with the pivot support portion 40A with the fixing screw 48.

In consequence, the thickness of the pivot support portion 40A raised from the attachment portion 39A for use in the attachment can substantially be increased owing to the spacer 45, and the attachment strength of the spring fixing pin 54 fixed to the spacer 45 can substantially be increased. At this time, the thickness of the pivot support portion 40A itself is not increased, and the thickness can substantially be increased owing to the separately formed spacer 45. Therefore, productivity can be improved.

On the other hand, the door stopper 35 and the shaft sleeve 51 are attached to the lower surface of the door 11. In this state, the rotary shaft 33 to be fixed to the main body 2 via the hinge 26 is inserted from the lower end opening of the shaft sleeve 51 on the door 11 side. The hinge 26 is similarly attached to the upper surface of the door 11, whereby the door 11 is supported rotatably around both the rotary shafts 33, and the front surface opening 6 of the storage chamber 3 can openably be closed.

According to the present invention, the hinge 26 is formed so that two attachment portions 39A, 39B cross each other at right angles in the corner 41 as described above. The hinge has two pivot support portions 40A, 40B which are raised from the attachment portions 39A, 39B, respectively, and to which the rotary shaft 33 for rotatably supporting the door 11 is attached. These portions are formed into such a shape that the portions are symmetric with respect to the line L passing through the corner 41 and forming an angle of 45° with respect to both the attachment portions 39A, 39B. Therefore, in a case where the side to which the hinge 26 is attached is changed from the one side to the other side, the door 11 is rotated in reverse, and the hinge 26 is rotated as much as 90° around the corner 41, whereby the door 11 can rotatably be attached using the same hinge 26 without any trouble. In a case where the rotation side of the door 11 is changed from the state described in the embodiment, the attachment portion 39B is used in attaching the door to the main body 2, and the rotary shaft 33 is attached to the pivot support portion 40B raised from the attachment portion 39B. It is to be noted that in this case, the attachment portion 39A for use in the attachment in the embodiment abuts on the front surface of the edge of the main body 2, and the pivot support portion 40A raised from the attachment portion 39A is positioned outside the main body 2.

In consequence, in an installation place, even in a case where the pivot support side of the door 11 with respect to the main body 2, that is, the attachment side with the hinge 26 is arbitrarily changed, the common hinge 26 can be used, whereby the decrease of the number of components and the improvement of convenience can be achieved.

In particular, according to the present embodiment, the rotary shaft 33 is detachably attached to the pivot support portion 40A or 40B. In consequence, the rotary shaft 33 is attached only to the pivot support portion on the pivot support side of the door 11, and the rotary shaft 33 is not attached to the pivot support portion on a side on which the door 11 is not pivotally supported. In such a state, the rotary shaft can be used, and it is possible to avoid a disadvantage that the rotary shaft 33 projects externally from the pivot support portion on the side on which the door 11 is not pivotally supported.

In consequence, even when the common hinge 26 is used, the disadvantage that the component projects externally can be avoided, and a preferable use configuration can be realized.

Moreover, in a state in which the door 11 is attached to the main body 2 as described above, the automatic closing mechanism 52 is attached to one or both of the upper and lower hinges 26. In the present embodiment, the automatic closing mechanism 52 is attached only to the lower hinge 26 on the downside of the door 11. In this case, the spring fixing pin 54 is engaged with and fixed to the pivot support portion 40A raised from the attachment portion 39A for use in the attachment of the hinge 26 via the spacer 45. On the other hand, the spring fixing pin 37 is engaged with and fixed to the lower surface of the door 11 together with the door stopper 35. Then, in a state in which the door 11 is closed, the compression spring 53 having the spring hook 55 attached to the one end 53A and the spring hook 56 attached to the other end 53B are engaged with the respective spring fixing pins 54, 37. That is, the spring hook 55 attached to the one end 53A of the compression spring 53 has the attachment hole 55A formed in the proximal end and held by the holding portion 54B of the spring fixing pin 54, and the spring hook 56 attached to the other end 53B of the compression spring 53 is held by the holding portion 37B of the spring fixing pin 37.

According to such a constitution, as shown in FIG. 5, in a case where the door 11 is rotated around the rotary shaft 33 and an open angle is smaller than an angle of an open position (a rotation angle) in which the rotary shaft 33 and the spring fixing pins 54, 37 are linearly arranged, the opened and extended compression spring 53 urges the door 11 in a closing direction. In consequence, the opened door 11 can automatically be closed owing to the elastic force of the compression spring 53. Therefore, the opened door 11 can appropriately automatically be closed, whereby it is possible to suppress disadvantages that cold air in the storage chamber 3 leaks more than necessary and that the temperature in the storage chamber 3 rises.

On the other hand, in a case where the door 11 is rotated around the rotary shaft 33 to the open position (the rotation angle) in which the rotary shaft 33 and the spring fixing pins 54, 37 are linearly arranged or in a case where the door is opened more, the extended compression spring 53 due to the opened door constantly urges the door 11 in an open direction owing to the elastic force of the spring. Therefore, even in a case where an operation such as display of commodities is performed in a state in which the door 11 is opened, a disadvantage that the door 11 closes owing to the automatic closing mechanism 52 can be avoided, and the operation can smoothly be performed.

Thus, owing to the elastic force of the compression spring 53, the door 11 is automatically closed, or constantly opened in a case where the door is opened more from a predetermined open position. In consequence, a force is easily applied to the end of the compression spring 53 as compared with another portion. However, the ends 53A and 53B are attached to the spring fixing pins 54, 37 via the spring hooks 55, 56, respectively. Therefore, the ends are not easily broken, and the durability of the compression spring 53 can be improved.

Moreover, in a case where the door 11 is opened, that is, a case where the door is rotated around the spring fixing pin 54 from a state in which the hook is substantially parallel to the pivot support portion 40A raised from the attachment portion 39A for use in the attachment, with regard to the distal end of the spring hook 55, the distal end of the pivot support portion 40B raised from the attachment portion 39B which is not used in the attachment of the hinge 26 is received in the escape portion 55C. In consequence, the spring hook 55 itself and the one end of the compression spring 53 pass by a front part before the pivot support portion 40B.

In consequence, the pivot support portion 40B which is not used in the attachment interferes with the spring hook 55 of the automatic closing mechanism 52 and the compression spring 53 attached to the spring hook 55, whereby a disadvantage that the open range of the door 11 is restricted or a disadvantage that the compression spring 53 itself abuts on the pivot support portion 40B and is damaged can be avoided.

What is claimed is:

1. A storage comprising: a main body; an upper hinge and a lower hinge attached to the main body; and a door having one side rotatably supported by both the hinges to openably close an opening, wherein at least one of the hinges has two attachment portions which cross each other at right angles in a corner and which are attached to the main body, and a pivot support portion extending from each of the attachment portions and provided with a rotary shaft rotatably supporting the door and detachably attached to both the pivot support portions, and both the attachment portions and both the pivot support portions have a shape which is symmetric with respect to a line passing through the corner and forming an angle of 45° with respect to both the attachment portions, further comprising: an automatic closing mechanism which urges the door in a closing direction, the automatic closing mechanism including a compression spring; a first pin provided in a position different from that of the rotary shaft on one of the pivot support portions; a second pin provided on the door; a first hook which connects one end of the compression spring to the first pin; and a second hook which connects the other end of the compression spring to the second pin, wherein one end of the compression spring is attached to the distal end of the first hook, the proximal end of the first hook is rotatably connected to the first pin, and the distal end of the first hook has such a shape that the distal end passes by a front part from the distal end of the other pivot support portion in a case where the door is opened.

2. The storage according to claim 1, wherein the first pin is attached to the pivot support portion via a spacer.

* * * * *